US005078751A

United States Patent [19]

Mizrahi et al.

[11] Patent Number: 5,078,751

[45] Date of Patent: Jan. 7, 1992

[54] PROCESS FOR UPGRADING OLEFINIC GASOLINE BY ETHERIFICATION WHEREIN ASYMMETRICAL DIALKYL ETHERS ARE PRODUCED

[75] Inventors: Sadi Mizrahi, Cherry Hill, N.J.; Charles M. Sorensen, Wilmington, Del.; Samuel A. Tabak, Wenonah, N.H.

[73] Assignee: Mobil Oil Corporation, Fairfax, Va.

[21] Appl. No.: 505,094

[22] Filed: Apr. 4, 1990

[51] Int. Cl.[5] ..... C10L 5/00

[52] U.S. Cl. ..... 44/448; 44/449; 568/694; 568/697

[58] Field of Search ..... 44/448, 449; 568/694, 568/697

[56] References Cited

U.S. PATENT DOCUMENTS

| | | | |
|---|---|---|---|
| Re. 28,398 | 4/1975 | Chen et al. | 208/111 |
| 2,046,243 | 6/1936 | Buc | 44/448 |
| 3,904,384 | 9/1975 | Kemp et al. | 44/56 |
| 4,181,598 | 1/1980 | Gillespie et al. | 208/58 |
| 4,247,388 | 1/1981 | Banta et al. | 208/111 |
| 4,393,250 | 7/1983 | Gottlieb | 568/697 |
| 4,443,327 | 4/1984 | Shihabi et al. | 208/97 |
| 4,544,776 | 10/1985 | Osterburg et al. | 568/697 |
| 4,647,703 | 3/1987 | Torck et al. | 568/697 |
| 4,664,675 | 5/1987 | Torck et al. | 44/60 |

OTHER PUBLICATIONS

*Chemical Engineers' Handbook*, 5th Edithion; by Robert H. Perry and Cecil H. Chilton; p. 15-2.

*Organic Chemistry*, Fourth Edition by Morrison and Boyd; Allyn and Bacon, Inc.; 1983: pp. 46,459-460.

The Merck Index, 11th Edition; Susan Budavari, Editor; 1989 Copyright; "Gasoline", Article 4270, p. 684.

Reynolds, R. W. et al., "Methyl ether (MTBE) scroes well as high-octane gasoline component", Oil and Gas Journal, 9/16/75, pp. 50-52.

Pecci, G. et al., "Ether ups antiknock of gasoline", Hydrocarbon Processing, 12/77, pp. 98-102.

Chase, J. D. et al., "MTBE and Tame—a good octane boosting combo", Oil and Gas Journal, 4/9/79, pp. 149-152.

*Primary Examiner*—Prince Willis, Jr.

*Assistant Examiner*—R. D. Flatter

*Attorney, Agent, or Firm*—Alexander J. McKillop; Charles J. Speciale; Robert B. Furr, Jr.

[57] ABSTRACT

A process is disclosed for upgrading $C_5$-$C_8$ olefin-containing gasoline to a high octane motor gasoline blending component.

$C_3$-$C_4$ olefins are hydrated to alcohols and then selectively removed from the aqueous hydration reactor effluent stream via liquid extraction with the gasoline feedstream. The alcohol enriched gasoline extract stream is then etherified and unreacted alcohols are extracted to yield a high octane gasoline blending component free of metal-bearing additives.

13 Claims, 1 Drawing Sheet

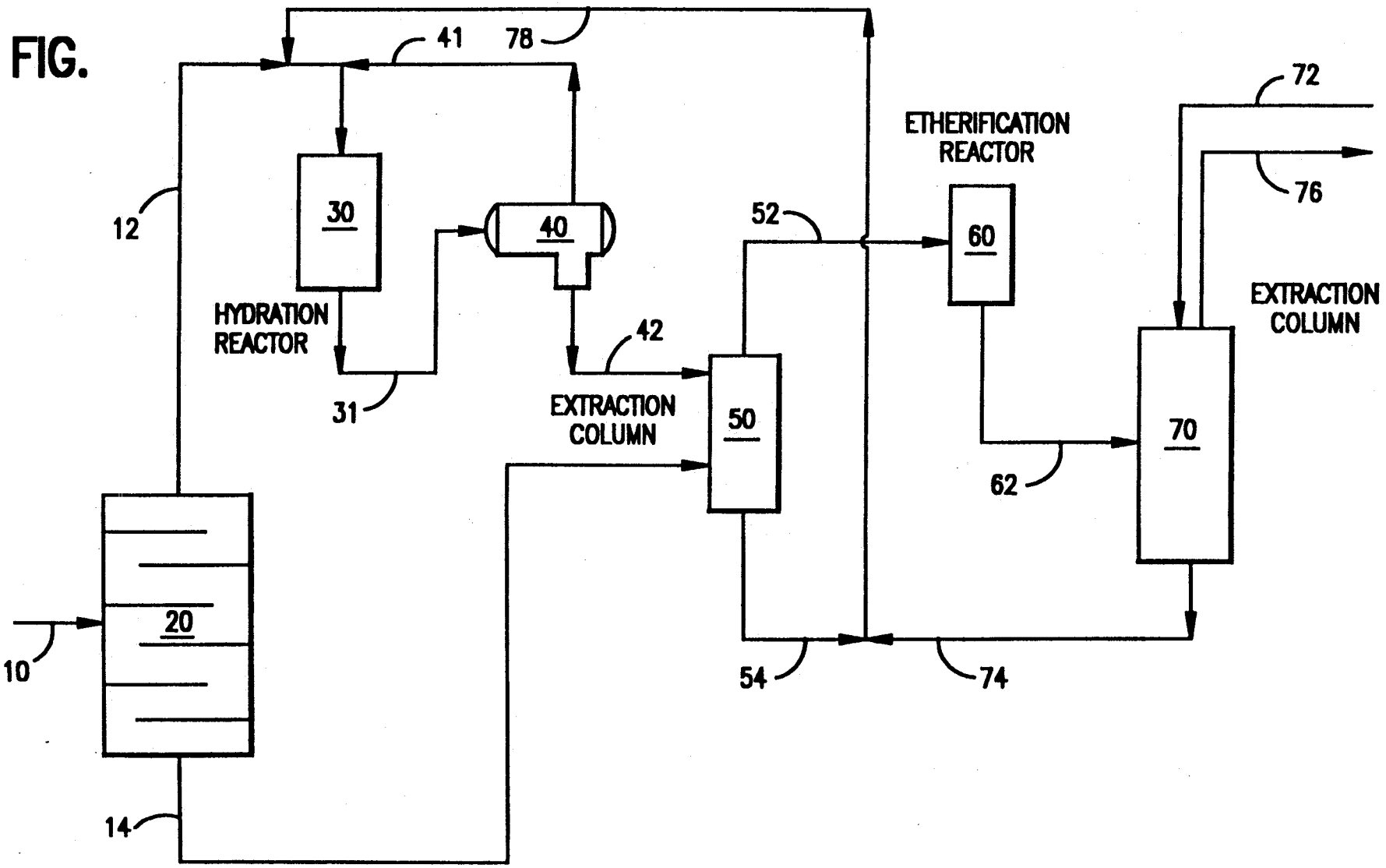
FIG.

PROCESS FOR UPGRADING OLEFINIC GASOLINE BY ETHERIFICATION WHEREIN ASYMMETRICAL DIALKYL ETHERS ARE PRODUCED

CROSS-REFERENCE TO RELATED APPLICATIONS

This application is replaced by disclosure of similar subject matter to commonly-assigned U.S. application Ser. No. 505,091, filed concurrently herewith.

FIELD OF THE INVENTION

The present invention relates to a process for upgrading the value of an olefinic gasoline stream. More particularly, the invention relates to an integrated process which converts a first portion of the olefinic gasoline feedstream to an octane-enhancing additive and employs a second portion of the feedstream as a solvent for liquid-liquid extraction.

BACKGROUND OF THE INVENTION

The art of petroleum refining and specifically the area of motor gasoline manufacture seeks to maximize the market value of a produced crude oil by weighing market demands against capital equipment and energy costs to define an optimum product distribution. The advent of higher performance automotive engine designs has shifted gasoline demand in recent years, notably increasing both the volumetric demand for premium gasoline as well as for the octane level required. Gasoline yield and octane rating are in fact so commonly considered together that the term "octane-barrel" has been defined by the industry as the multiplicative product of the gasoline octane rating and the produced volume in units of barrels.

Previous octane-enhancing processes generally imposed a liquid product penalty in that a portion of the liquid feedstock was converted to light $C_4$- gas rather than to liquid gasoline. The inverse relationship between gasoline volumetric yield and octane rating posed a particularly perplexing problem to the refining industry in view of changing market demands.

For example, a typical catalytic reforming process upgrades paraffinic naphtha to high octane reformate over a metallic catalyst in the presence of hydrogen. Increasing severity (e.g., reactor temperature) produces a higher octane liquid product but also shifts selectivity away from the liquid product toward less valuable $C_4$-light aliphatic gases. Thus the incremental value of increasing reformate octane is mitigated to a certain degree by lost gasoline volume.

Gasoline additives, e.g., tetraethyl lead, present another option for meeting octane barrel requirements. While various refinery streams respond differently to such additives, lead additives improve octane in almost all refinery gasoline streams, and certain streams such as alkylate gasoline from a sulfuric or hydrofluoric acid alkylation unit show marked improvements in motor (MON) and research (RON) octane numbers. The widespread use of these additives is however, being phased out to decrease automotive exhaust emissions.

Research efforts have more recently focused on upgrading gasoline by blending methyl, propyl or isopropyl ethers of tertiary butyl ether with gasoline range hydrocarbons, and further on producing these ethers at a commercially competitive cost. Examples of such processes are taught in U.S. Pat. Nos. 4,664,675 and 4,647,703 to Torck et al. These processes feed an olefinic gasoline to an etherification zone where the gasoline in reacted with methanol to obtain an effluent containing methyl tertiary amyl-ether. The unreacted methanol is extracted with water and the aqueous extract is fractionated to recycle unreacted methanol. The operating costs associated with the extract fractionation column impose an economic burden which can reasonably be expected to worsen with rising energy costs.

U.S. Pat. No. 3,904,384 to Kemp teaches a process for producing ether-rich gasoline from a single source of C4 hydrocarbons by hydrating isobutane with propylene to obtain isopropyl tertiary butyl ether which is then blended with a gasoline stream.

U.S. Pat. No. 4,393,250 to Gottlieb et al. discloses a process for etherifying isobutylene by first hydrating propylene to isopropyl alcohol and then etherifying the isobutylene with the produced isopropyl alcohol.

The ability of lower alkyl ethers to enhance octane has drawn attention primarily to the use of methanol to etherify isobutylene to form MTBE, or to etherify isopentane (isoamylene) to yield tertiary amyl-ether (TAME). Methanol is both relatively inexpensive and readily available. Further, methanol is known to etherify isoalkenes more readily than secondary or tertiary olefins. For example, U.S. Pat. No. 4,544,776 to Osterburg et al. cites methanol as a preferred alcohol for the etherification of $C_4$–$C_7$ olefins. The specific olefinic gasoline feedstocks useful in the present invention are relatively undesirable as motor gasolines. To upgrade their characteristically low octane, such streams have been proposed as feedstocks for catalytic aromatization processes such as the Mobil M-2 Forming process. While aromatization clearly achieves the objective of increased octane rating, the process decreases product volume.

Clearly then it would be desirable to provide an energy efficient process for upgrading the market value of $C_3$–$C_8$ olefinic gasolines without producing substantial quantities of less valuable light aliphatic gases.

SUMMARY OF THE INVENTION

The present invention is predicated upon several related discoveries. First, it has been found that longer chain ($C_5$+) olefins can be catalytically etherified with heavier ($C_3$–$C_5$) alcohols, and that the etherification reaction rate, selectivity, and yield are commercially viable. Second, it has surprisingly been found that the longer chain ethers evolved in such a process improve gasoline octane much more dramatically than could be predicted from the behavior of smaller ethers, for example, methyl ether. Third, it has been found that a portion of the gasoline feedstream may be used to recover alcohols from an aqueous alcohol mixture, eliminating the need for expensive distillation or for the disposal or regeneration of spent extraction solvents.

More specifically, it has been found that a given gasoline stock containing the isopropyl ethers of a given group of $C_5$+ isoalkenes has a surprisingly higher octane rating than the same gasoline stock containing a like molar proportion of a methyl ether of the same given group of $C_5$+ isoalkenes.

In addition to all of the foregoing, it has further been found that certain olefinic gasoline streams may be used as the sole hydrocarbon feedstream. One example of such a gasoline feedstream is $C_3$–$C_8$ catalytically cracked gasoline, for example, from a fluid catalytic cracking (FCC) process unit. Other examples of such feedstreams include $C_3$–$C_8$ coker gasoline from a delayed coking unit, as well as the $C_3$–$C_8$ olefinic naphtha byproduct of a catalytic distillate or lube hydrodewaxing process. For an overview of catalytic dewaxing processes, see U.S. Pat. Nos. Re 28,398, 4,181,598, 4,247,388, and 4,443,327, all of which are incorporated herein by reference.

The olefinic gasoline streams useful as feedstocks in the present invention are all relatively difficult to upgrade by catalytic reforming by virtue of their olefinicity and further contain a substantial $C_3$–$C_4$ or "front end" fraction, which deleteriously raises their vapor pressure above that desirable for motor gasolines. The present invention fractionates the gasoline feedstream and converts these $C_4$- light fractions into the corresponding alcohols and employs the remaining $C_5$–$C_8$-rich gasoline fraction first as an extraction solvent to recover these alcohols and then as an etherification reactant to convert at least a portion of the $C_5$–$C_8$ tertiary olefins in the gasoline stream to octane-enhancing etherates.

Thus the process of the invention decreases energy costs in comparison with previous tertiary olefin etherification processes by eliminating the alcohol-water distillation column. Rather than fractionating the alcohol-water mixture, the present process uses the $C_5$–$C_8$ fraction of the gasoline stream as an extraction solvent. This highlights a further benefit of the present process, namely, that solvent extraction is effectively carried out without incurring costs for disposal or regeneration of the solvent.

DESCRIPTION OF THE DRAWING

The FIGURE is a simplified schematic diagram showing major processing steps of the present invention.

DETAILED DESCRIPTION

The reaction of methanol with isobutylene, isoamylene, and higher tertiary olefins, at moderate conditions with a resin catalyst is taught by R. W. Reynolds et al. in the *Oil and Gas Journal*, June 16, 1975; by S. Pecci and T. Floris in *Hydrocarbon Processing*, December, 1977; and, by J. D. Chase et al. in the *Oil and Gas Journal*, Apr. 16, 1979, pp. 149–152. The preferred catalyst is Amerlyst 15 brand sulfonic acid resin available from Rohm and Haas Corporation. None of the cited articles teaches etherification of $C_5$+ olefins, and particularly $C_5$ to $C_9$ iso-olefins with $C_3$+ alcohols, or isopropyl alcohol.

The following description assumes that $C_3$–$C_4$ olefins may be readily incorporated into a $C_5$–$C_8$ olefin-containing gasoline stream by adjusting process conditions in an upstream fractionation tower in a refinery complex. However, the complex interactions between process units in a petroleum refinery to meet various product specifications as well as other factors such as process unit upsets or maintenance shutdowns may cause the single $C_3$–$C_8$ feedstream to deviate from its most preferred composition. Thus if the supply of $C_3$–$C_4$ olefins is insufficient to meet the demand at the hydration reactor, an auxiliary olefin stream may be added. Suitable sources include the product fractionation sections downstream from delayed coking units, catalytic hydrodewaxing units, or catalytic cracking units. In the most preferred embodiment of the present invention, the $C_3$–$C_8$ olefin-containing gasoline stream is produced by the initial fractionation of a catalytic cracking unit product stream. Examples of such catalytic cracking processes are taught in U.S. Pat. Nos. 2,383,636 to Wirth, 2,689,210 to Leffer, 3,338,821 to Moyer et al., 3,812;029 to Snyder, Jr., 4,093,537 to Gross et al., and 4,218,306 to Gross et al., the disclosures of which are incorporated by reference as if set forth at length herein.

Catalytic cracking process units typically include a dedicated product fractionation section. The first fractionation vessel generally receives the total cracked product effluent and is referred to as the "main column".

The initial fractionation of the catalytic cracking unit product stream in the main column is conventionally controlled to produce an overhead vapor stream enriched in $C_4$- hydrocarbons. The most preferred embodiment of the present invention requires that at least a portion of the $C_3$–$C_4$ olefins be shifted from this overhead vapor stream to a liquid gasoline side stream. The $C_3$–$C_8$ olefin containing side stream from the main column is then the most preferred feedstream for use in the present process.

Referring now to the FIGURE, a $C_3$–$C_8$-containing gasoline feedstream having at least 10% by weight of tertiary olefins is charged to fractionator 20 via line 10. The gasoline source is not critical, but the $C_3$–$C_4$ content of the gasoline is critical, as is the $C_5$–$C_8$ tertiary olefin content. Specifically, the gasoline stream must contain a sufficient quantity of $C_3$–$C_4$ olefins to provide a molar ratio of monohydric alcohols to tertiary $C_5$–$C_8$ olefins in a downstream etherification reactor of from about 1.02:1 to about 2:1. The conversion of alkenes to alkanols in the hydration reactor typically exceeds 50% by weight and preferably exceeds 80% by weight. Thus, a particularly preferred gasoline feedstock composition would include $C_3$–$C_4$ olefins and $C_5$–$C_8$ tertiary olefins in a weight ratio of from about 1.28:1 to about 4:1.

The configuration of fractionator 20 is not critical except to the extent that the overhead and bottoms streams achieve the desired purity. The overhead stream 12 is enriched in $C_3$–$C_4$ aliphatics and preferably contains less than about 5% by weight of $C_5$+ hydrocarbons. The bottom stream 14, on the other hand, is enriched in $C_5$+ hydrocarbons and preferably contains less than about 5% by weight of $C_4$- aliphatics.

Hydration of the lower olefins occurs in a hydration zone provided by a reactor 30 in which the lower olefins are reacted with water in the presence of a suitable catalyst, to form a mixture of alcohols, a large portion of which are branched chain. The hydration reaction is carried out in reactor 30, in the presence of a hydration catalyst, under conditions of pressure and temperature chosen to yield predominantly $C_3$–$C_5$ alkanols, preferably secondary alcohols. The reaction may be carried out in the liquid, vapor or supercritical dense phase, or mixed phases, in semi-batch or continuous manner using a stirred tank reactor or a fixed bed flow reactor.

It is preferred to carry out the hydration reaction in the liquid phase, for economy. From 1–20 moles of water, preferably from 8–12 moles, are used per mole of alkenes. The space velocity in liters of feed per liter of catalyst per hour is 0.3–25, preferably 0.5–10. The reaction is carried out at a pressure in the range from about 30–100 bar, preferably 40–80 bar and at a temperature in the range from about 100° C. (212° F.) to about 200° C.

(392° F.), preferably from 110° C. (230°) to 160° C. (320°).

One preferred hydration reaction for the lower olefins utilizes a strongly acidic cation exchange resin catalyst, as disclosed in U.S. Pat. No. 4,182,914 to Imaizumi; another hydration reaction utilizes a medium pore shape selective metallosilicate catalyst as disclosed in U.S. Pat. No. 4,857,664 to Huang et al, the disclosures of both of which are incorporated by reference thereto as if set forth at length herein. It is preferred to use phosphonated or sulfonated resins, such as Amberlyst 15, over which a $C_3$=-rich stream forms isopropyl alcohol, and substantially no methanol. The term "substantially no methanol" is defined as being less than 10% by weight of the alkanols formed. Under the foregoing conditions more than 50% of the alkenes are converted to alkanols, and preferably from 80% to 90% of the propene is converted, with recycle of unreacted olefins to the hydration reactor, to isopropyl alcohol and diisopropyl ether. In an analogous manner, butenes are converted to branched chain butyl alcohols and $C_4$-alkyl ethers. The effluent from the hydration reactor 30 leaves under sufficient pressure, typically about 20 bar, to keep unreacted olefins in solution with an aqueous alcoholic solution. This effluent, referred to as the "hydrator effluent", leaves through conduit 31 to be separated in a downstream separation zone.

The separation zone comprises separation means 40, which is preferably a relatively low pressure zone, such as a flash drum, which functions as a single stage of vapor-liquid equilibrium, to separate unreacted olefins from the aqueous alcoholic effluent, referred to as hydrator effluent. The unreacted olefins are recycled from the flash drum 40 to the hydration reactor 30 through conduit 41.

The pressure in the flash separator is preferably from about 69 kPa (10) psig to about 140 kPa (20 psig), slightly higher than the operating pressure of the liquid-liquid extraction vessel 50 to which the substantially olefin-free hydrator effluent is flowed through conduit 42, for extraction of the alcohols. The hydrator effluent may be cooled by heat exchange with a cool fluid in a heat exchanger (not shown), to lower the effluent's temperature in the range from about 27° C. (80° F.) to about 94° C. (200° F.) to provide efficient extraction with gasoline, as will be detailed below.

The gasoline bottom stream 14 from fractionator 20 is charged to a lower section of extraction column 50 where it contacts the aqueous alcohol solution (hydration effluent) from flash drum 40 flowing through line 42. As will be evident to one skilled in the art, the desired composition of the ether-rich product gasoline, the conditions of the etheration reaction, and the particular composition of primary and secondary alcohols in the hydrator effluent, inter alia, will determine the mass flow of the gasoline stream.

Typically the ratio of weight of aqueous alcohol fed per hour through conduit 42 to extraction column 50, to that of the weight of $C_5$–$C_8$ olefinic gasoline fed through conduit 14 is in the range from about 4:1 to about 1:4. The process conditions in the extraction column 50 are chosen to extract the alcohols from the alcoholic solution, into the gasoline stream while the aqueous and organic phases are flowing of the extraction column 50 as liquids. Though extraction may be carried out at elevated temperature and atmospheric pressure, relatively lower temperatures than the operating temperature of the flash separator, and pressure in the range from about 170 kPa (10 psig) to about 1135 kPa (150 psig) is preferred. The raffinate consists essentially of gasoline range hydrocarbons and alcohols which are fed to etherification reactor 60 via line 52. The solvent phase from extraction column 50 consists essentially of water with less than 5% by weight of alcohols, and a negligible amount, less than 1% by weight of hydrocarbons. This solvent phase if flowed through conduit 54 and recycled to the hydration reactor 30 via line 78.

The particular type of extractor means used is not critical provided the unit operation is executed efficiently. Thus while the present embodiment is described with reference to an extraction column, various other contactor configurations may also be effective. The desired extraction may be done in co-current, cross-current or single stage contactors as taught in The Kirk-Othmer Encyclopedia of Chemical Technology, (Third Ed.) pp 672–721 (1980) and other texts, using a series of single stage mixers and settlers, but multistage contactors are preferred. The operation of specific equipment is disclosed in U.S. Pat. Nos. 4,349,415 to DeFilipi et al, and 4,626,415 to Tabak. Most preferred is a packed column, rotating disk, or other agitated column, using a countercurrent multi-stage design.

When isopropanol (IPA), produced in the hydration reactor 30 is reacted with 2-methyl-1-butene, tert-amyl-isoproyl either is formed. In an analogous manner, when sec-butyl alcohol is reacted with isohexene, tert-hexyl-2-butyl ether is formed. The ratio of isopropyl ethers to sec-butyl ethers produced in the etheration reactor 60 will be related to the ratio of IPA to sec-butyl alcohol produced in the hydration reactor 30, although the conditions in the hydration reactor can be controlled to some extent to control the relative production of isopropyl ethers and sec-butyl ethers. In general, the etherification of the $C_5$–$C_8$ olefinic gasoline stream with branched chain alcohols produces $C_8$–$C_{11}$ branched chain ethers which are essentially free from ethers having less than 8 carbon atoms ($C_8$—). As before, the term "essentially free" refers to a stream having less than 10% by weight of $C_8$— ethers.

The molar ratio of monohydric alcohols to tertiary olefins in the etherification reactor 60 is suitably in the range from about 1:1 to about 2:1, preferably from about 1.2:1 to 1.5:1, which preferred range of ratio provides conversion of essentially all, typically from 93 to 98% of the tert-olefins, such as the isoamylenes, isohexenes and isoheptenes, and most of the secondary alcohols, typically from more than 50% to 75%, are reacted. The ratio of unreacted secondary and tertiary alcohols to tert-olefins in the etherated effluent is in the range from 50:1 to about 1000:1 by weight, while the combined weight of on-tert-olefins leaving the etherification reactor is essentially the same as that of their weight entering the reactor. In general terms, substantially all the olefins which are not tert-olefins (the "non-tert-olefins"), such as the pentenes, hexenes and heptenes, remain unreacted.

To react essentially all the tert-olefins and isopropyl alcohol and sec-butyl alcohol in the raffinate, the temperature is maintained in the range from about 20° C. (68° F.) to about 150° C. (302° F.) and at elevated pressure in the range from 8 to 16 bar. Under preferred conditions of pressure, in the range from about 1035 kPa (150 psig) to about 2860 kPa (400 psig), the temperature in the etherification zone is controlled in the range between 38° C. (100° F.) to about 93° C. (200° F.) to maximize the etheration of essentially all the tert-olefins with secondary alcohols.

The space velocity, expressed in liters of feed per liter of catalyst per hour, is in the range from about 0.3 to about 50, preferably from 1 to 20.

Preferred etherification catalysts are the cationic exchange resins and the medium pore shape selective metallosilicates such as those disclosed in the aforementioned '914 Imaizumi and '664 Huang et al patents, respectively. Most preferred cationic exchange resins are strongly acidic exchange resins consisting essentially of sulfonated polystyrene, manufactured and sold under the trademarks Dowex 50, Nalcite HCR, Amberlyst 35 and Amberlyst 15.

The etherified effluent from the reactor 60, which effluent contains a minor proportion, preferably less than 20% by weight of unreacted alcohols, is flowed through conduit 62 to a second liquid-liquid extractor 70 where the etherified effluent is contacted with solvent wash water from line 72 which extracts the alcohols. The conditions for extraction of the etherated effluent with wash water are not as critical. Extraction column 70 is conveniently operated at ambient temperature and substantially atmospheric pressure, and the amount of wash water used is modulated so that the aqueous alcoholic effluent from extraction column 70, flowing through line 74, combined with the aqueous solvent phase from the extraction column 50, flowing through line 54 is approximately sufficient to provide reactant water in the hydration reactor 30. This combined stream flows through line 78, entering line 12 upstream of hydration reactor 30.

The raffinate from extraction column 70 flowing through conduit 76 is an ether-rich gasoline and other components in the gasoline range.

Typically, 15% tert-olefins in the $C_3$-$C_8$ gasoline feedstream results in more than 5% ethers by weight in the product gasoline. Since the most preferred gasoline feedstream used herein may contain from 30% to about 70% tert-olefins, the benefits accrued to the process are much greater than those derived from the presence of only 10% tert-olefins, though the latter benefits will be significant.

The product, ether-enriched gasoline, is unique in that it is essentially free of methyl-tert-butyl ether and consists essentially of (i) $C_5$-$C_8$ hydrocarbons in which at least 50% by weight is olefinic $C_5$-$C_8$= and less than 10% and typically, essentially none (less than 1% by wt) of the olefins is a tert-olefin, and, (ii) a mixture of asymmetrical $C_8$+ dialkyl ethers present in an amount from about 5% to about 20% by weight of the gasoline product.

The product gasoline is distinguished over other ether-containing gasolines by its gas chromatographic (GC) trace (spectrum) which serves definitively to "fingerprint" the product gasoline by the distribution of oxygenates in it. The following procedure is followed:

A gas chromatograph is used to separate the constitutents of the gasoline, each of which constituents is sent through an oxygen-specific flame ionization detector (O-FID) which detects only oxygenates (such an instrument is made by ES Industries, Marlton, N.J.). Oxygenates detected include water, molecular oxygen, alcohols, and ethers. The pattern of peaks due to heavy ($C_8$+) ethers is distinctive.

It is the presence of the $C_8$+ dialkyl ethers in the product gasoline which is believed contributes to the unexpected improvement in octane number, on the basis of the gasoline's oxygen content (% by wt), which improvement is several-fold greater, typically more than five times than that provided by methyl ethers of substantially the same tert-olefins when the ethers in each gasoline is present in the amount of 10% by weight.

EXAMPLES

The following data illustrate the advantage of etherifying gasoline with isopropanol. The gasoline used was a 215° F. endpoint light gasoline from a fluid catalytic cracking process having a composition as shown in Table 1.

This gasoline contained about 41 weight % $C_4$-$C_8$ olefins. It was mixed with reagent grade isopropanol in a molar ratio of 2:1 alcohol:olefin. The reactant stream was then passed through a fixed bed reactor containing 4 $cm^3$ Amberlyst 15 acidic catalyst mixed with 6 $cm^3$ of inert quartz chips. Reactor conditions were fixed at 1000 psig and 10 LHSV, and variable temperatures between 150° and 250° F. Products were collected at room temperature and washed repeatedly with distilled water to remove unreacted alcohol. Products were characterized by octane measurement, simulated distillation, and oxygen analysis, (ASTM M1294). The oxygenate distributions in the products were further characterized by gas chromatography using an oxygen specific detector.

Results are shown in Table 2 for the base gasoline and water-washed products from isopropanol etherification indicting that the etherification product has improved motor and research octanes compared to the base gasoline.

TABLE 1

FCC Gasoline Composition

| Class | Weight Percent |
|---|---|
| $C_5$− Paraffins | 16.50 |
| $C_6$+ Paraffins | 27.56 |
| $C_5$− Olefins | 23.28 |
| $C_6$+ Olefins | 17.50 |
| $C_{10}$+ PON | 2.88 |
| $C_5$-$C_6$ Naphthenes | 5.33 |
| Aromatics | 6.99 |

TABLE 2

Comparison of FCC gasoline Etherification with Methanol versue Isopropanol At 150° F.

| | RON | ΔRON | MON | ΔMON | Wt % O |
|---|---|---|---|---|---|
| Base gasoline | 92.7 | — | 80.3 | — | 0 |
| Methyl etherate | 93.3 | +0.6 | 80.1 | −0.2 | 1.4 |
| Isopropyl etherate | 93.5 | +0.8 | 80.7 | +0.4 | 0.4 |

Surprisingly, etherification of the sample FCC gasoline with isopropanol yields a significantly greater octane improvement than methanol. This is completely unexpected, especially in view of the fact that the methyl etherate contains a greater weight percentage of oxygen than the isopropyl etherate.

Changes and modifications in the specifically described embodiments can be carried out without departing from the scope of the invention which is intended to be limited only by the scope of the appended claims.

We claim:

1. An integrated process for improving the value of an olefin-containing gasoline stream comprising the steps of:

(a) providing an olefinic gasoline feedstream containing $C_3$–$C_8$ olefins;

(b) fractionating said olefinic gasoline feedstream to evolve a first stream enriched in $C_3$–$C_4$ olefins and a second gasoline stream enriched in $C_5$–$C_8$ olefins;

(c) converting at least 30% by weight of the $C_3$–$C_4$ olefins contained in said first stream of step (b) in a hydration zone to a hydration zone effluent containing alcohols in an aqueous mixture comprising isopropyl alcohol and sec-butyl alcohol with $C_3$–$C_4$ primary alcohols;

(d) fractionating said hydration zone effluent into a recycle stream rich in $C_3$–$C_4$ olefins and a purified hydrate stream containing alcohols in an aqueous mixture comprising isopropyl alcohol and sec-butyl alcohol with $C_3$–$C_4$ primary alcohols;

(e) extracting said alcohols from said purified hydrate stream with said olefin-enriched second gasoline stream of step (b) until said olefin-enriched gasoline contains a sufficient quantity of secondary alcohols to etherify at least 80% by weight of the tertiary olefins in said olefin-enriched gasoline, and until less than 5% by weight of the $C_5$–$C_8$-olefin-enriched second gasoline stream is contained in the raffinate;

(f) etherifying the extract stream of step (e) in the presence of an acidic catalyst to evolve an etherated effluent consisting essentially of (i) unreacted alcohols, (ii) asymmetrical $C_8$+ dialkyl ethers of the $C_5$–$C_8$-olefin-enriched gasoline, and, (iii) said $C_5$–$C_8$- olefin-enriched gasoline in which at least 90% by weight of the non-tertiary olefins are left unreacted;

(g) extracting the etherified effluent with water under extraction conditions favorable to selective extraction of $C_3$–$C_4$ alcohols to yield gasoline product essentially free from $C_3$–$C_4$ alcohols and enriched in etherified tertiary olefins to provide an upgraded gasoline product stream without the addition of a $C_5$+ hydrocarbon stream other than said olefinic gasoline feedstream of step (a).

2. The process of claim 1 further comprising controlling the fractionation of step (b) to provide said first and said second streams in relative quantities such that upon conversion of at least 40% of the $C_3$–$C_4$ olefins in said first stream to alcohols, the amount of $C_3$+ alcohols extractable from the hydration effluent by the $C_5$–$C_8$ olefin-enriched second gasoline provides a sufficient quantity of $C_3$+ secondary alcohols in the extract to etherify at least 80% of the tert-olefins therein, and yield product gasoline consisting essentially of (i) gasoline boiling range hydrocarbons containing $C_5$–$C_8$=, and, (ii) etherated $C_5$–$C_8$= resulting in ethers in which each alkyl group is $C_3$+.

3. The process of claim 1 wherein said product gasoline is enriched with from 1% to about 20% by weight of a dialkyl ether having at least 8 carbon atoms, and said dialkyl ether is selected from the group consisting of isopropyl and sec-butyl ethers of said $C_5$–$C_8$ olefins.

4. The process of claim 1 wherein in step (c) said aqueous mixture is essentially free of n-propanol, and said product gasoline is produced without separating the components of a process stream in a distillation zone.

5. The process of claim 2 wherein said $C_5$–$C_8$ olefinic gasoline is the product of a catalytic cracking process.

6. The process of claim 1 wherein said olefinic gasoline stream contains up to about 70% by weight of said tert-alkenes.

7. The process of claim 1 including in addition, separating said hydration effluent to provide an azeotrope of alcohols and water for use in step (d).

8. A process for producing upgraded etherified gasoline comprising the steps of:

(a) catalytically cracking a gas oil to a cracked product stream containing $C_1$–$C_{10}$ hydrocarbons;

(b) fractionating said cracked product stream in a primary fractionation zone;

(c) withdrawing a gasoline stream enriched in $C_3$–$C_8$ olefins from said primary fractionation zone;

(d) fractionating said withdrawn $C_3$–$C_8$ olefin-containing gasoline stream in a second fractionation zone into a first stream enriched in $C_3$–$C_4$ olefins and a second gasoline stream enriched in $C_5$–$C_8$ olefins, of which olefins at least 10% by weight are tertiary olefins;

(e) charging said first stream of step (d) to an olefin hydration zone;

(f) converting at least 40% by weight of the $C_3$–$C_4$ olefins in said hydration zone of step (e) to alcohols under hydration conditions to produce an aqueous mixture essentially free of n-propanol, which aqueous mixture comprises isopropyl and sec-butyl alcohols, said aqueous mixture flowing from said hydration zone as a hydration effluent;

(g) extracting said hydration effluent of step (f) with said second $C_5$–$C_8$ olefin-containing gasoline stream of step (d), under extraction conditions favorable to selective extraction of alcohols, to extract said mixture of alcohols into said gasoline in a first extraction zone, (h) reacting essentially all of said tertiary-olefins in said $C_5$–$C_8$ olefin-containing gasoline, with at least a portion of the isopropyl alcohol and sec-butyl alcohol evolved in step (f), in the presence of an acidic catalyst under conditions to produce an etherified effluent consisting essentially of (i) unreacted alcohols, (ii) asymmetrical dialkyl ethers of the $C_5$–$C_8$ olefin-containing gasoline, and, (iii) said gasoline in which at least 90% of the non-tertiary-olefins are left unreacted, and, (i) extracting said etherated effluent with water under extraction conditions favorable to selective extraction of unwanted $C_3$–$C_4$ alcohols to yield product gasoline essentially free from said $C_3$–$C_4$ alcohols in a second extraction zone;

whereby the lower olefin feed stream is upgraded to product gasoline having a greater improvement in octane number, on the basis of the oxygen content (% by weight) of said product gasoline, than the improvement provided by a methyl-etherate or ethyl-etherate of said $C_5$–$C_8$ olefin-containing gasoline.

9. The process of claim 8 wherein said $C_5$–$C_8$ olefin-containing stream contains a major proportion of $C_5$–$C_8$ olefins in which the ratio of branched to linear olefins is more than 2.5

10. The process of claim 8 wherein upon conversion of $C_3$–$C_4$ olefins to said alcohols, the amount of $C_3$+ alcohols extractable from said hydration effluent by said $C_5$–$C_8$ olefin-containing gasoline provides a sufficient quantity of $C_3$+ secondary alcohols in said $C_5$–$C_8$ olefin-containing gasoline to effect etherification of at least 80% of said tertiary-olefins therein, to yield a product gasoline consisting essentially of (i) gasoline boiling range hydrocarbons containing $C_5$–$C_8$ olefins resulting in ethers in which each alkyl group has at least 3 carbon atoms.

11. The process of claim 10 wherein said product gasoline is enriched with from about 5% to about 25% by weight with said $C_5$–$C_8$ dialkyl ethers, and said dialkyl ethers are selected from the group consisting of isopropyl and sec-butyl ethers of said $C_5$–$C_8$ olefins.

12. An ether-rich gasoline product free of an alkyl lead additive and essentially free from methyl-tert-butyl ether, said gasoline product produced directly from catalytically cracked $C_3$–$C_8$ olefin-containing gasoline without blending a base gasoline with ethers in a finishing step, by the steps of (a) catalytically cracking a gas oil to a cracked product stream containing $C_1$–$C_{10}$ hydrocarbons;

(b) fractionating said cracked product stream in a primary fractionation zone;

(c) withdrawing a gasoline stream enriched in $C_3$–$C_8$ olefins from said primary fractionation zone;

(d) fractionating said withdrawn $C_3$–$C_8$ olefin-containing gasoline stream in a second fractionation zone into a first stream enriched in $C_3$–$C_4$ olefins and a second gasoline stream enriched in $C_5$–$C_8$ olefins, of which olefins at least 10% by weight are tertiary olefins;

(e) charging said first stream of step (d) to an olefin hydration zone;

(f) converting at least 30% by weight of the $C_3$–$C_4$ olefins in said first stream of step (d) to alcohols under hydration conditions to produce an aqueous mixture comprising isopropyl alcohol and sec-butyl alcohol with $C_3$–$C_4$ primary alcohols, said mixture flowing from said hydration zone as a hydration effluent, (g) extracting said alcohols from said hydration effluent into said gasoline stream under conditions favorable to selective extraction of the mixture until a sufficient quantity of secondary alcohols is extracted into the gasoline stream to etherify at least 80% by weight of the tertiary-olefins in the gasoline, and there is less than 5% by weight of $C_5$–$C_8$ olefin-containing gasoline in the raffinate;

(h) etherifying said extract in the presence of an acidic catalyst under conditions to produce an etherified effluent consisting essentially of (i) unreacted alcohols, (ii) asymmetrical dialkyl ethers of the $C_5$–$C_8$ olefin-containing gasoline; and, (iii) said gasoline containing $C_5$–$C_8$ olefins in which at least 90% of the non-tertiary-olefins are left unreacted; and, (i) extracting the etherified effluent with water under extraction conditions favorable to selective extraction of unwanted $C_3$–$C_4$ alcohols, to yield product gasoline essentially free from said $C_3$–$C_4$ alcohols, whereby said lower olefin feedstream is upgraded to said product gasoline without using a hydrocarbon stream not generated from said lower olefin feed stream, and without separating the components of a process stream in a distillation zone.

13. The product gasoline of claim 12 wherein it is enriched with from about 5% to about 25% by weight with said $C_5$–$C_8$ dialkyl ethers, and said dialkyl ethers are selected from the group consisting of isopropyl and sec-butyl ethers of said $C_5$–$C_8$ olefins; and, said dialkyl ethers provide a higher boost in octane number, on the basis of oxygen content (% by weight), than methyl ethers of said $C_5$–$C_8$ olefins.

* * * * *